US007708007B2

(12) United States Patent
Kim et al.

(10) Patent No.: US 7,708,007 B2
(45) Date of Patent: May 4, 2010

(54) DOOR ASSEMBLY FOR HOME APPLIANCE, ELECTRIC OVEN USING THE SAME, AND METHOD FOR OPERATING ELECTRIC OVEN

(75) Inventors: Jong Sik Kim, Seoul (KR); Yang Kyeong Kim, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/564,490

(22) Filed: Nov. 29, 2006

(65) Prior Publication Data

US 2007/0125760 A1 Jun. 7, 2007

(30) Foreign Application Priority Data

Dec. 2, 2005 (KR) ..... 10-2005-0116836

(51) Int. Cl.
*F23M 7/04* (2006.01)

(52) U.S. Cl. ..... 126/198; 126/190; 126/193; 126/200; 110/175 R

(58) Field of Classification Search ..... 110/175 A, 110/175 R, 180, 182; 126/190, 193, 198, 126/200, 287
See application file for complete search history.

(56) References Cited

U.S. PATENT DOCUMENTS 3,025,681 A * 3/1962 Booth ..... 62/248
3,311,106 A * 3/1967 Baughman et al. ..... 126/200
3,331,943 A * 7/1967 Eff ..... 219/398
3,624,742 A * 11/1971 Hurko et al. ..... 126/39 D
3,659,578 A * 5/1972 Davis et al. ..... 126/21 R
3,692,015 A * 9/1972 Chase et al. ..... 126/200
3,710,776 A * 1/1973 Frick ..... 126/200
3,749,081 A * 7/1973 Wilson ..... 126/200
3,859,499 A * 1/1975 Evans et al. ..... 219/396
3,911,893 A * 10/1975 Baker et al. ..... 126/21 A
3,990,635 A * 11/1976 Restle et al. ..... 126/591
4,041,930 A * 8/1977 Katona ..... 126/198
4,050,911 A * 9/1977 Welsh ..... 96/103
4,111,643 A * 9/1978 Welland ..... 432/48
4,150,659 A * 4/1979 Buckley ..... 126/589

(Continued)

FOREIGN PATENT DOCUMENTS

DE 102004008463 B3 * 3/2005

(Continued)

OTHER PUBLICATIONS

U.S. Appl. No. 11/459,706 to Kim et al., which was filed on Jul. 25, 2006.

(Continued)

*Primary Examiner*—Kenneth B Rinehart
*Assistant Examiner*—Jorge Pereiro
(74) *Attorney, Agent, or Firm*—McKenna Long & Aldridge LLP

(57) ABSTRACT

A door assembly for a home appliance includes a door that opens and closes a heating chamber. The door may include a first plate and a second plate, the first and second plates forming a first air gap in the door for insulating heat in the heating chamber. Additionally, a valve may be provided in the door, the valve may selectively allow air outside the first air gap to communicate with the first air gap.

13 Claims, 7 Drawing Sheets

U.S. PATENT DOCUMENTS

| | | | | | |
|---|---|---|---|---|---|
| 4,206,338 | A | * | 6/1980 | Katona | 219/740 |
| 4,237,865 | A | * | 12/1980 | Lorenz | 126/599 |
| 4,253,286 | A | * | 3/1981 | Katona | 52/171.1 |
| 4,280,647 | A | * | 7/1981 | Nilsson | 227/147 |
| 4,313,418 | A | * | 2/1982 | Schrader et al. | 126/287 |
| 4,354,084 | A | * | 10/1982 | Husslein et al. | 219/757 |
| 4,651,709 | A | * | 3/1987 | Schnetker | 126/77 |
| 4,686,891 | A | * | 8/1987 | Pouchard | 454/256 |
| 5,284,127 | A | * | 2/1994 | Driesmans | 126/77 |
| 5,387,258 | A | * | 2/1995 | Puricelli | 126/21 A |
| 5,738,081 | A | * | 4/1998 | Puricelli | 126/21 A |
| 6,488,024 | B2 | * | 12/2002 | Champion | 126/77 |
| 6,904,904 | B2 | * | 6/2005 | Walther et al. | 126/198 |
| 7,126,097 | B2 | | 10/2006 | Kim et al. | |
| 2005/0133019 | A1 | | 6/2005 | Kim et al. | |
| 2006/0086151 | A1 | | 4/2006 | Kim et al. | |
| 2006/0086154 | A1 | | 4/2006 | Kim | |
| 2006/0090521 | A1 | | 5/2006 | Kim et al. | |
| 2006/0232176 | A1 | | 10/2006 | Kim et al. | |
| 2007/0017387 | A1 | | 1/2007 | Kim et al. | |

FOREIGN PATENT DOCUMENTS

| | | | | |
|---|---|---|---|---|
| EP | 1209420 | A 1 | * | 5/2002 |
| EP | 1566594 | A1 | * | 8/2005 |
| FR | 2437484 | A | * | 5/1980 |
| FR | 2545526 | A | * | 11/1984 |

OTHER PUBLICATIONS

U.S. Appl. No. 11/615,370 to Kim et al., which was filed on Dec. 22, 2006.

U.S. Appl. No. 11/609,480 to Kim et al., which was filed on Dec. 12, 2006.

* cited by examiner

DOOR ASSEMBLY FOR HOME APPLIANCE, ELECTRIC OVEN USING THE SAME, AND METHOD FOR OPERATING ELECTRIC OVEN

This application claims the benefit of the Korean Patent Application No. 10-2005-0116836, filed on Dec. 2, 2005, which is hereby incorporated by reference for all purposes as if fully set forth herein.

BACKGROUND OF THE INVENTION

1. Field of the Invention

The present invention relates to a door assembly which opens and closes a heating chamber of home appliance, to an electric oven employing the door assembly, and to method for operating the electric oven.

2. Discussion of the Related Art

Electric oven is an apparatus which heats food deposited in a heating chamber thereof using heaters operable by electricity, such as, a ceramic heater, a sheath grill heater, and/or a halogen heater.

Electric oven can cook food quickly and has a high thermal efficiency. In addition, electric oven is relatively safe from a fire started by a flame compared to gas oven. Therefore, electric oven gets more popular nowadays.

Meanwhile, dirt including ingredient of food and oil sticks to inner walls of the heating chamber of the electric oven while cooking. It is hard for the user to clean the dirt stuck to the inner walls of the heating chamber. Therefore, some electric ovens provide a special function which automatically cleans the inner walls of the heating chamber.

During the operation of the electric oven in an automatic cleaning mode, heaters of the electric oven heats up the heating chamber to a very high temperature, for example, over 450 degree Celsius higher than a temperature from 100 to 300 degree Celsius at which food is cooked. Therefore, the dirt stuck to the inner walls of the heating chamber is pyrolyzed and carbonized during the automatic cleaning mode. After the electric oven finishes the automatic cleaning mode, the user can easily remove carbonized dirt from the inner walls of the heating chamber by sweeping it with a brush.

Heat in the heating chamber is transferred to a door which opens and closes the heating chamber when the heaters heat up the heating chamber to cook food or to clean the inner walls of the heating chamber. Because the door is also heated by the heaters during the operation of the electric oven, the user may get a burn in case he/she accidentally touches the door during the operation of the electric oven, especially in the automatic cleaning mode.

In order to solve this problem, some electric ovens automatically cool down the door during the operation of the electric oven. These electric ovens include a fan that forms air flows running through an inner space of the door during the operation of the electric oven. The air flow generated by the fan usually cools down an inner surface of the door as well as an outer surface of the door while running through the inner space of the door. Therefore, the heating chamber as well as the door is cooled down by the air flow running through the door.

Accordingly, thermal efficiency of electric oven decreases when the fan cools the door during the operation of the electric oven. In addition, food deposited in the heating chamber is not evenly cooked because an area in the heating chamber adjacent to the door is so cooled compared to another area in the heating chamber opposite to the side adjacent to the door. Further, cooking time of electric oven increases.

SUMMARY OF THE INVENTION

Accordingly, the present invention is directed to a door assembly for home appliance, an electric oven using the same, and a method for operating the electric oven that substantially obviate one or more of the problems due to limitations and disadvantages of the related art.

An object of the present invention is to minimize a loss of thermal efficiency of a home appliance. Further, a user may be prevented from burns caused by accidentally (or otherwise) touching the door of a home appliance, e.g., during the operation of an electric oven in a cooking or an automatic cleaning mode.

Another object of the present invention is to improve efficiency for cooling an electric outfit room of an electric oven.

Additional features and advantages of the invention will be set forth in the description which follows, and in part will be apparent from the description, or may be learned by practice of the invention. The objectives and other advantages of the invention may be realized and attained by the structure particularly pointed out, by way of non-limiting embodiments, in the written description and claims hereof as well as the appended drawings.

To achieve these objects and other advantages and in accordance with the purpose of the invention, as embodied and broadly described herein, a door assembly for a home appliance may include a door which opens and closes a heating chamber, the door may have a first plate and a second plate, the first and second plates may form a first air gap in the door for insulating heat in the heating chamber; and a valve may be provided in the door to selectively allow air outside the first air gap to communicate with the first air gap.

The door assembly may further include a third plate located proximate (or arranged next to) the first or second plate to form a second air gap between the third plate and the first or second plate, wherein the second air gap forms an air flow passage for cooling the door.

The door assembly may further include a lock which selectively locks the door. Further, the valve may be operatively coupled to the lock (i.e., operable by the lock). The lock may include an actuator; and a rod operatively couple to the actuator (i.e., coupled to and operable by the actuator), the rod moving the valve to open a portion of the first air gap while locking the door. The valve may include a first member which opens and closes a portion of the first air gap; a second member movable along with the first member by the lock; a pivot about which the first and second members rotate together when the lock touches (or engages) the second member; and an elastic member which allows the first and second members to return to an initial position of the first and second members.

In another aspect of the present invention, an electric oven includes a case; a heating chamber in the case; a door which opens and closes the heating chamber. Further, the door may include a first glass facing the heating chamber and a second glass located in the door, the first and second glasses may form a first air gap in the door; and a valve may be provided in the door, the valve permitting air to enter the first air gap to cool the door or preventing air from entering the first air gap to insulate heat in the heating chamber.

The electric oven may further include: a third glass proximate (or arranged next to) the second glass to form a second air gap between the second and third glasses; and a supporter which supports the first, second, and third glasses thereon, the supporter permitting air to flow into the second air gap while preventing air from flowing into the first air gap.

The electric oven may further include a lock which selectively locks the door, wherein the valve is operable by the lock. The lock may include an actuator; and a rod coupled to and operable by the actuator, the rod moving the valve to open the first air gap while locking the door. The actuator may be mounted in the case so that it swings the rod to hook the door and pushes the valve. Alternatively, the actuator may be mounted in the case so that it pushes out the rod to hook the door and pushes the valve. Of course, it should be appreciated that any suitable mounting arrangements can be employed.

The valve may include a first member which opens and closes a portion of the first air gap; and a second member movable along with the first member by the lock; a pivot about which the first and second members rotate together when the lock touches the second member; and an elastic member which allows the first and second members to return to an initial position of the first and second members.

The valve may permit the air to flow into the first air gap to cool the door when a temperature of the heating chamber reaches a preset value. Alternatively, the valve may permit the air to flow into the first air gap to cool the door when the electric oven performs a preset operation mode.

The electric oven may further include a fan which introduces air outside the case into the case to cool a circumference of the heating chamber and into the door to cool the door. The electric oven may further include a first vent hole on the case, which introduces air outside the case to a proximity (or vicinity) of a control panel to cool the control panel. The electric oven may further include a second vent hole provided on the case, which introduces air outside the case to a vicinity of a motor of the fan to cool the motor.

In still another aspect of the present invention, an electric oven include a case; a heating chamber in the case; a door which opens and closes the heating chamber, the door including a first air gap therein and a second air gap therein; a fan provided in the case, the fan allowing air to flow through the second air gap to cool the door; a valve provided in the door, the valve permits air to enter the first air gap to either cool the door or prevent air from entering the first air gap to insulate heat in the heating chamber, selectively.

In still another aspect of the present invention, a method for operating an electric oven includes heating a heating chamber of the electric oven; and either flowing air through an air gap provided in a door of the heating chamber to cool the door or preventing air from entering the air gap to insulate heat in the chamber, selectively.

It is to be understood that both the foregoing general description and the following detailed description of the present invention are exemplary and explanatory and are intended to provide further explanation of the invention as claimed.

BRIEF DESCRIPTION OF THE DRAWINGS

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Reference will now be made in detail to an embodiment of the present invention, examples of which are illustrated in the accompanying drawings. Wherever possible, the same reference numbers will be used throughout the drawings to refer to the same or like parts.

Figure 1:
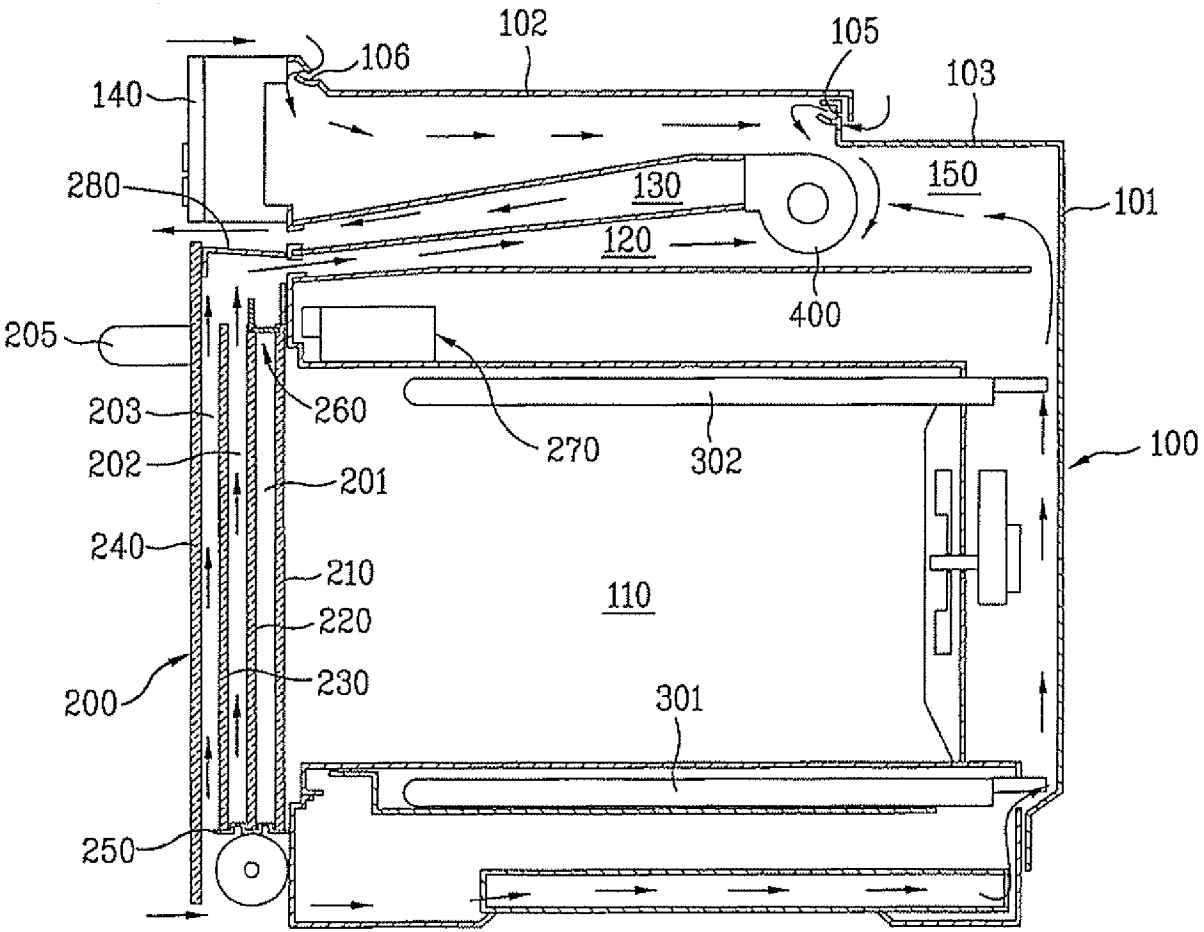
FIG. 1 is a cross sectional view schematically illustrating an electric oven including a door assembly according to the present invention.

FIG. 1 is a cross sectional view schematically illustrating an electric oven including a door assembly according to the present invention. As shown in FIG. 1, the electric oven includes a case 100, a heating chamber 110 provided in the case 100, a door assembly including a door 200 provided at a front of the case 100 for opening and closing the heating chamber 110, and an electric outfit room 150 provided in an upper portion of the case 100, i.e., above the heating chamber 110.

The case 100 may have a hexahedral shape and includes a back plate (or rear plate) 101 which forms a rear of the case 100, a top plate which forms a top of the case 100, side plates (not shown) that form both sides of the case 100, and a bottom plate that forms a bottom of the case 100.

A cooktop or a hob (not shown) may be provided above the electric oven. In this case, a space for electric wiring and piping to be arranged is necessary between the case 100 and the cooktop or the hob. For this, the top plate of the case 100 may have a stepped portion which divides the top plate into a front portion 102 and a rear portion 103 lower than the front portion 103, as shown in FIG. 1. The front and the rear portions (102 and 103, respectively) may be formed as one body, but may be formed as a separate body as shown in FIG. 1. In FIG. 1, the rear portion 103 of the top plate and the rear plate 101 are formed as one body and the rear portion 103 of the top plate is extended from a top of the rear plate 101 towards the stepped portion of the top plate after being bent.

A plurality of heaters 301 and 302 are provided with the electric oven for heating the heating chamber 110 so that food deposited in the heating chamber 110 is cooked or dirt stuck to inner walls of the heating chamber 110 is pyrolyzed and carbonated. In FIG. 1, the heater 301 is provided under a bottom of the heating chamber 110 and the heater 302 is provided at an upper portion of the heating chamber 110. The heathers 301 and 302 may include a ceramic heater, a halogen heater, and/or a sheath grill heater. A convection fan may blow air into the heating chamber 110 to form convention currents in the heating chamber 110 during operation of the electric oven in a cooking mode or an automatic cleaning mode.

A control panel 140 is provided at an upper portion of the front of the case 100, above the door 200 as shown in FIG. 1. The control panel 140 has a plurality of buttons (not shown) at a front thereof for the user to press to control the electric oven. A rear of the control panel 140 faces the electric outfit room 150 as shown in FIG. 1.

The electric outfit room 150 accommodates a plurality of electric parts, for example, a printed circuit board. A fan 400 operable by a motor (not shown) and a second duct 130 are provided in the electric outfit room 150 for cooling the case 100 surrounding the heating chamber 110 as well as the electric outfit room 150.

More particularly, a first opening (not shown) is provided at a lower portion of the case 100, and an air flow passage in communication with the first opening and the electric outfit room 150 is provided between the case 100 and the heating chamber 110 to surround a part of an outer circumference of the heating chamber 110, as shown in FIG. 1. The second duct 130 is in communication with an outlet of the fan 400 and a second opening provided at the upper portion of the case 100, for example, between the door 200 and the control panel 140.

The air outside the electric oven (FIG. 1) is introduced into the case 100 through the first opening provided at the lower portion of the case 100 and flows through the air flow passage between the case 100 and the heating chamber 110 when the fan 400 operates, and thereby the case 100 and the outer circumference of the heating chamber 110 are cooled down. Therefore, the case 100 is prevented from being heated enough to hurt the user and the heating chamber 110 is also prevented from being overheated. After cooling the case 100 and the heating chamber 110, the air enters the electric outfit room 150 and is eventually discharged toward the outside of the case 100 by the fan 400 via the second duct 130 and the second opening, and thereby the electric outfit room 150 is cooled down.

The air entered the electric outfit room 150 from the air flow passage does not circulate within the electric outfit room 150 because the air entered the electric outfit room 150 is inhaled by the fan 400 as soon as the air enters the electric outfit room 150. Therefore, the control panel 140, the motor of the fan 400, and other electric/electronic parts placed within the electric outfit room 150 are not sufficiently cooled down by the air introduced into the electric outfit room 150 from the air flow passage by the fan 400.

In order to solve this problem, a first vent hole 106 may be provided on the case 100, for example at a proximity (or vicinity) of the control panel 140, as shown in FIG. 1. Then, air introduced into the electric outfit room 150 via the first vent hole 106 can cool down the rear of the control panel 140 and other electric/electronic parts while circulating within the electric outfit room 150 before being sucked by the fan 400.

In addition, a second vent hole 105 may be provided on the case 100, e.g., at a proximity (or vicinity) of the motor of the fan 400. Then, the air introduced into the electric outfit room 150 via the second vent hole 105 can cool down the motor of the fan 400 before being sucked by the fan 400 while flowing around the motor of the fan 400. Accordingly, the first and the second vent holes 106 and 105 provided on the case 100 notably improve efficiency for cooling the electric outfit room 150 of electric oven.

As explained above, the fan 400 cools the case 100, the heating chamber 110, and the electric outfit room 150. In addition, according to the present invention, the fan 400 may further cool the door 200 down as well.

For this, the door 200 may be constituted such that the air outside the case 100 is able to be introduced therein, and a first duct 120 may be provided to guide the air introduced in the door 200 to the fan 400. As the fan 400 cools the door 200 down, the user is prevented from getting a burn even if he/she accidentally touches the door 200 when the electric oven cooks food or pyrolyzes dirt stuck to the inner walls of the heating chamber 110. In addition, the heating chamber 110 is also prevented from being overheated.

In addition, the door 200, according to the present invention, may isolate the heat in the heating chamber 110 in order to increase the thermal efficiency of the electric oven when the electric oven cooks food.

Figure 2:
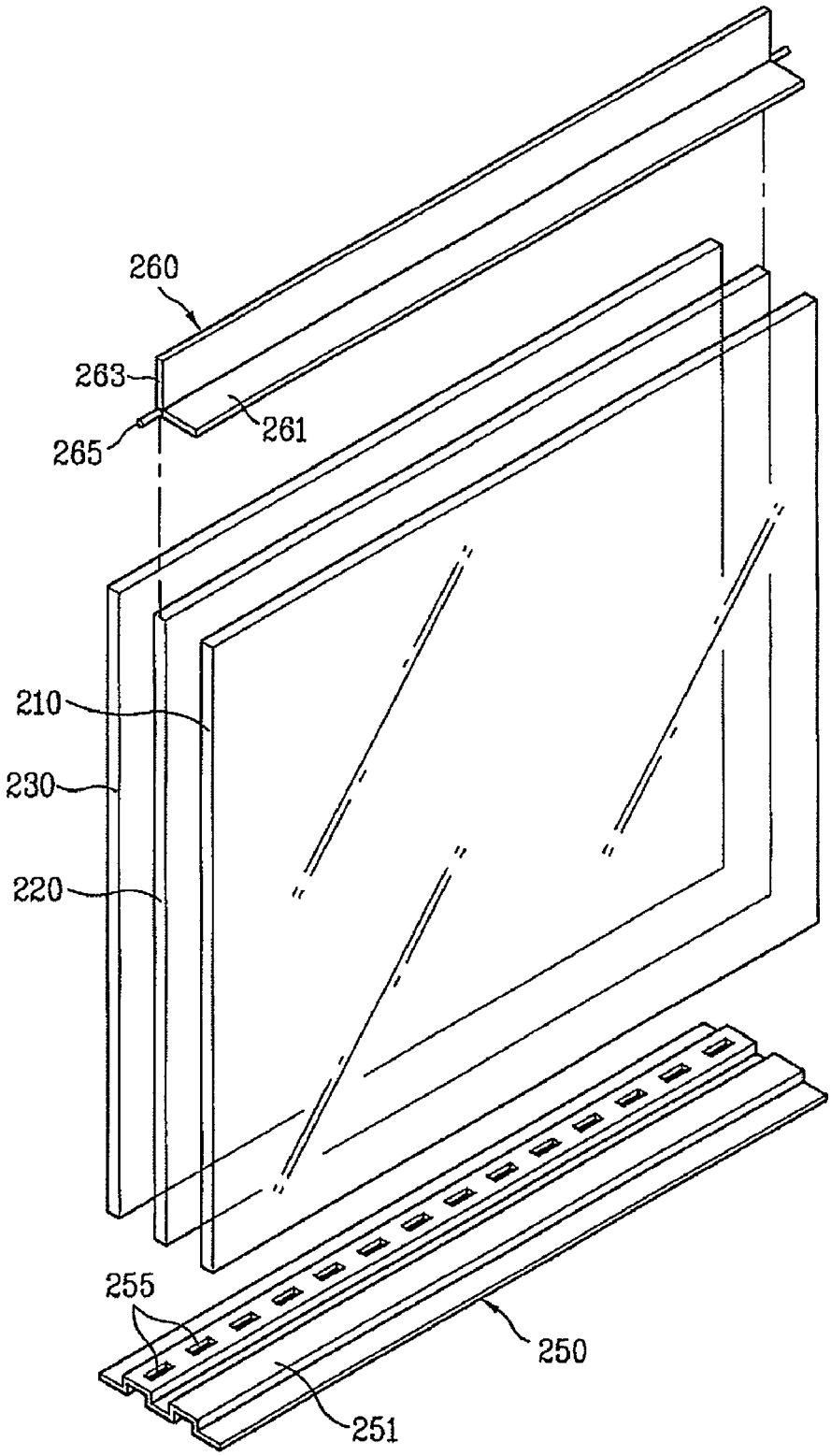
FIG. 2 is an exploded perspective view of the door assembly according to the present invention.

An embodiment of the door 200 is shown in FIGS. 1 and 2. Therefore, more detailed explanation about the door 200 will be described, referring to FIGS. 1 and 2. FIG. 2 is an exploded perspective view of the door assembly according to the present invention.

The door 200 may include a frame 280 forming a circumference of the door 200, a handle 205 provided at a front of the door 200 for the user to grip when opening and closing the door 200, and a plurality of plates forming an inner and an outer surfaces of the door 200 and also forming air gaps within the door 200 in order to prevent the heat in the heating chamber 110 from being transmitted to the outside of the door 200 through the door 200. The plurality of plates may be constituted as a plurality of glasses so that the user can see the heating chamber 110 and can easily clean the inner surface of the door 200 facing the heating chamber 110.

As shown in FIG. 1, the plurality of plates may include a first glass 210, a second glass 220, a third glass 230, and a fourth glass 240. The first glass 210 forms the inner surface of the door 200 and faces and seals the heating chamber 110 when the door 200 is closed. The forth glass 240 forms the outer surface of the door 200 and supports the handle 205 thereon. The second glass 220 is arranged within the door 200, e.g., next to the first glass 220 and the third glass 230 is arranged between the second glass 220 and the fourth glass 240.

The four glasses 210, 220, 230, and 240 are arranged with a gap therebetween, and thereby a first air gap 201 is provided between the first glass 210 and the second glass 220, a second air gap 202 is provided between the second glass 220 and the third glass 230, and a third air gap 203 is provided between the third glass 230 and the fourth glass 240.

The number of plates or glasses, however, is not limited to the above mentioned example. Alternatively, only one glass may be provided between the first glass 210 and the fourth glass 240. In this case, two air gaps may be provided within the door 200. Alternatively, only two glasses from the inner and the outer surfaces of the door 200 may be provided with the door 200. In this case, only one air gap may be provided within the door 200. Alternatively, a plurality of glasses over five may be provided with the door 200. In the followings, however, one example which has four glasses mentioned above and shown in the drawings will be described in detail for convenience.

The four glasses 210, 220, 230, and 240 are secured to the frame 280. The frame 280 may cover both sides and a top of the door 200 but may not cover a bottom of the door 200 so that the air outside the case 100 may be introduced into the door 200 through the bottom of the door 200. A space is secured between the second and the third glasses (220 and 230, respectively) and a portion of the frame 280 forming the top of the door 200. An opening 204 is provided at the frame 280 to allow the first duct 120 to be in communication with the space within the door 200.

A supporter 250 may be provided at the bottom of the door 200 to support the first, the second, and the third glasses 210, 220, and 230, as shown in FIGS. 1 and 2. The supporter 250 secures the bottoms of the first, the second, and the third glasses 210, 220, and 230. The supporter 250 however does not secure the fourth glass 240, and thereby a lower portion of the third air gap 204 is open, as shown in FIG. 1. The supporter 250 may include a ridge 251 located between two adjacent glasses when the supporter 250 secures the glasses. The ridge 251 of the supporter 251 secures the first air gap 201 between the first glass 210 and the second glass 220 and the second air gap 202 between the second glass 220 and the third glass 230.

The ridge located between the second glass 220 and the third glass 230 may include a plurality of slots 255 which permits the air outside the case 100 to enter the second air gap 202 through the slots 255, as shown in FIG. 2. On the contrary, the ridge located between the first glass 210 and the second glass 230 may have no slot so that the air outside the case is prevented from entering the first air gap 201 through the bottom of the door 200.

When the fan 400 operates, the air outside the case 100 flows into the door 200 through the bottom of the door 200. The air introduced into the door 200 through the bottom of the door 200 goes to the space within the door 200 after flowing through the second air gap 202 and the third air gap 203. However, the air introduced into the door 200 through the bottom of the door 200 does not flow through the first air gap 201 because the supporter 250 covers a lower portion of the first air gap 201. Nevertheless, the air moved to the space may enter the first air gap 201 because an upper portion of the air gap 201 is open.

The air moved to the space within the door 200 moves towards an inlet of the fan 400 via the opening 204 and the first duct 120. Then, the fan 400 discharges the air toward outside of the case through the second duct 130 whose outlet is located between the control panel 140 and the top of the door 200 as shown in FIG. 1. Accordingly, the door 200 and the electric outfit room 150 are cooled down.

During the operation of the electric oven in the automatic cleaning mode for pyrolyzing dirt stuck to the inner walls of the heating chamber 110, the heating chamber 110 is heated up to a high temperature, for example, over 450 degree Celsius. Accordingly, the door 200 is also heated and thereby it is dangerous for the user to touch the door 200. In order to protect the user, it is preferable that the door 200 is cooled down by the fan 400 during the operation of the electric oven in the automatic cleaning mode. When the fan 400 operates, the heating chamber 110 is also protected from being overheated.

During the operation of the electric oven in the cooking mode for cooking food, the heating chamber 110 is heated up to a temperature in a range from about 100 to about 300 degree Celsius. In this case, the door 200 is not heated up to a high temperature and thereby the user does not get a burn even if he/she accidentally touches the door 200. Accordingly, it is preferable that the door 200 isolates the heat in the heating chamber 110 in order to improve the thermal efficiency of the electric oven while the electric oven cooks food.

A valve 260 may be provided in the door 200. The valve 260 is able to selectively open and close any one of the air gaps 201, 202, and 203 in order to selectively allow the air outside the air gap closable by the valve 260 to communicate with the air gap closable by the valve 260. In the embodiment shown in FIGS. 1 and 2, the valve 260 is provided to selectively open and close the first air gap 201 in order to selectively allow the air outside the first air gap 201 to communicate with the first air gap 201.

When the valve 260 closes the upper portion of the first air gap 201 as shown in FIG. 1, the air introduced into the door 200 cannot enter the first air gap 201, and thereby the first air gap 201 plays a role as an insulating air gap. The first air gap 201 therefore can isolate the heat in the heating chamber 110 during the operation of the electric oven in the cooking mode and thereby the thermal efficiency of the electric oven increases.

The second air gap 202 and the third air gap 203 can work as an air flow passage, respectively, when the fan 400 operates during the operation of the electric oven in the cooking mode, while the first air gap 201 works as the insulating air gap. In this case, the air running through the second air gap 202 and the third air gap 203 cools down the fourth glass 240 forming the outer surface of the door 200, and thereby the user is prevented from getting a burn even if he/she touches the door 200. Meanwhile, the valve 260 may be operable by an independent actuator (not shown) provided within the case 100.

A lock 270 may be provided in the electric oven according to the present invention. The lock 270 may selectively lock the door 200 in order to prevent the door 200 from being open during the operation of the electric oven, especially in the automatic cleaning mode. The lock 270 may operate the valve 260 when locking the door 260, different from the above.

Figure 3:
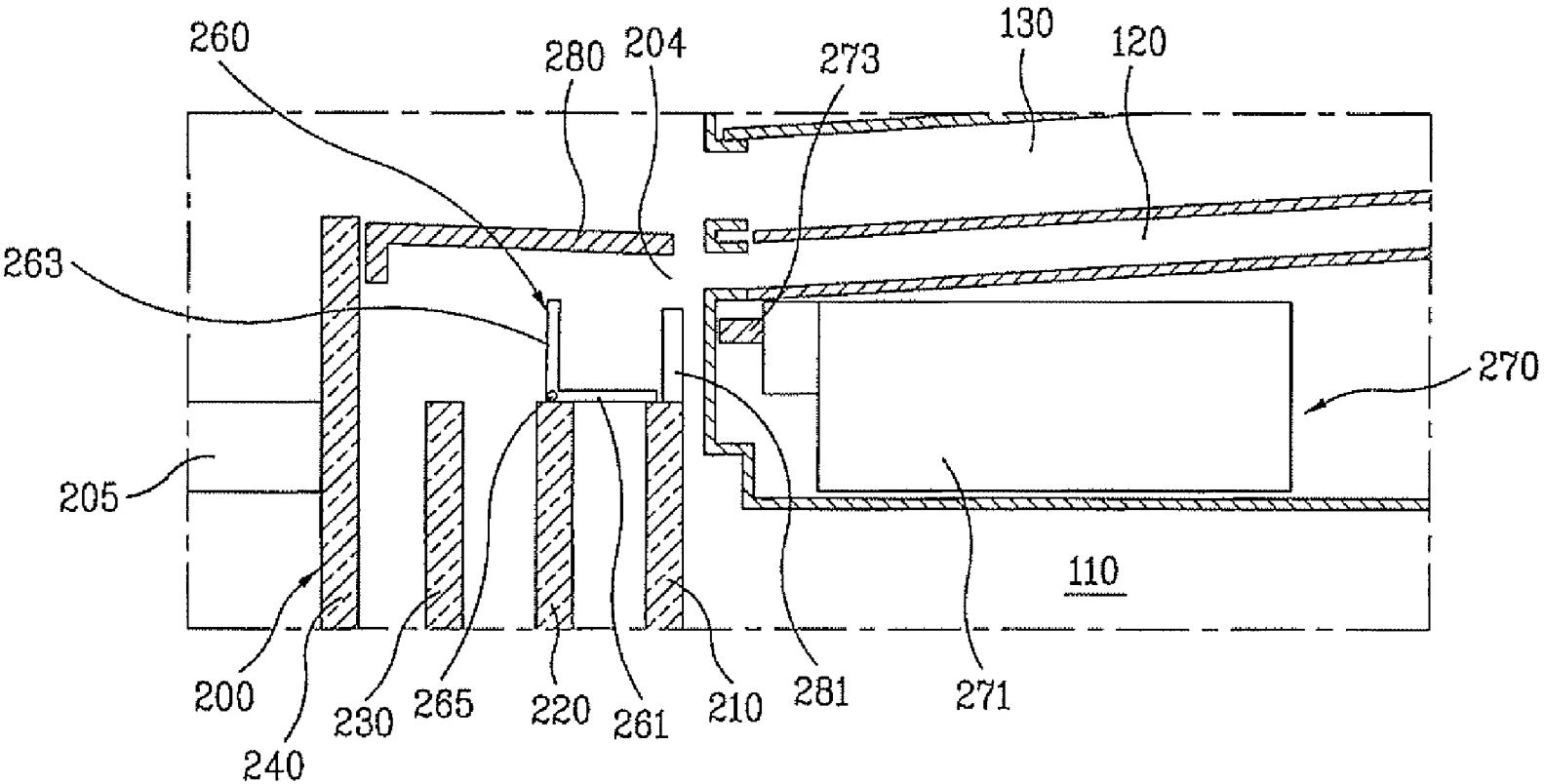
FIG. 3 is a partial sectional view schematically illustrating the lock and the valve of the door assembly according to the first embodiment of the present invention when the door of the electric oven is unlocked.
Figure 4:
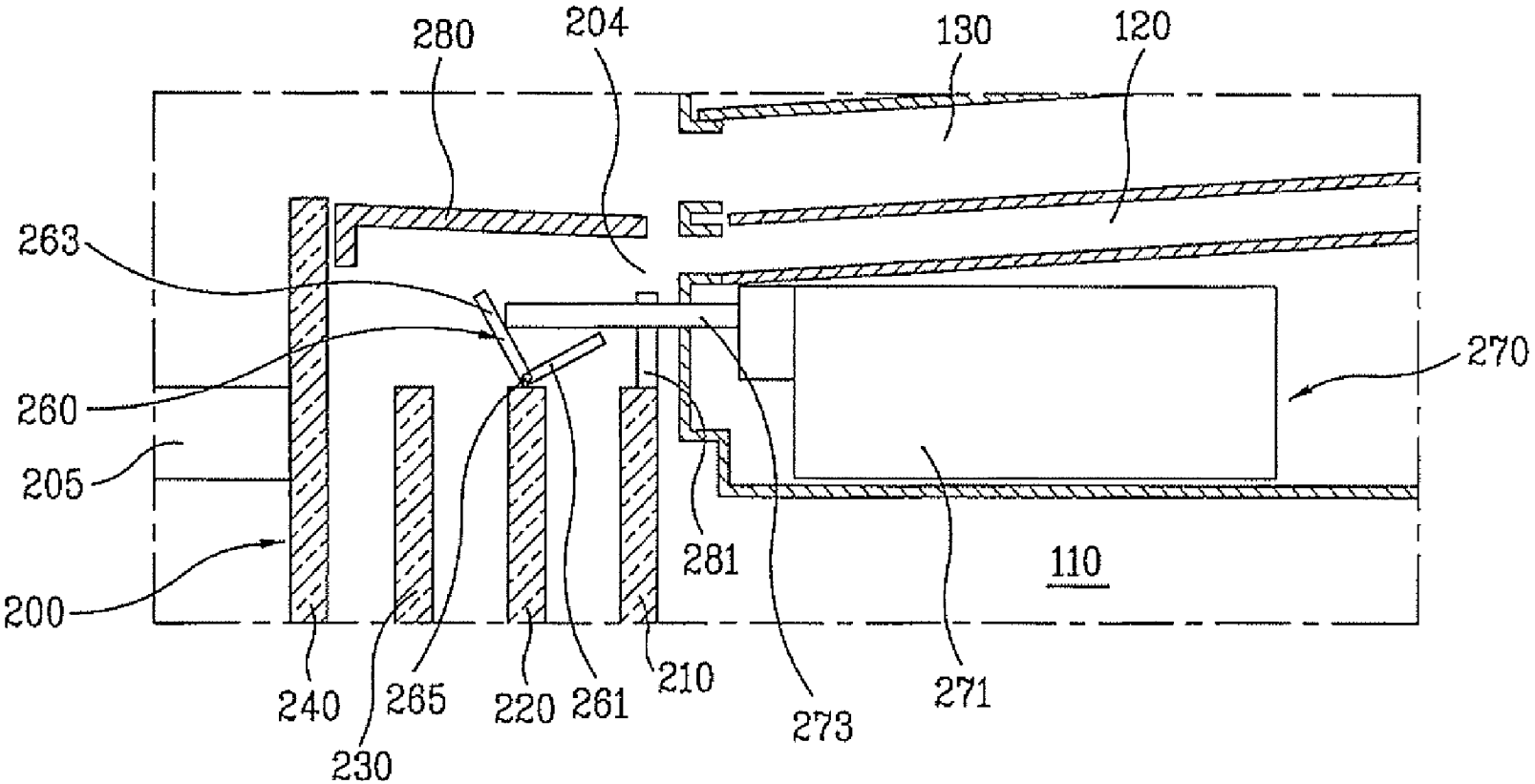
FIG. 4 is a partial sectional view schematically illustrating the lock and the valve of the door assembly according to the first embodiment of the present invention when the door of the electric oven is locked.

The valve 260 and the lock 270 may be embodied as several embodiments. FIGS. 3 and 4 show the valve 260 and the lock 270 according to the first embodiment of the present invention. Therefore, more detailed explanation about the valve 260 and the lock 270 will be described referring to FIGS. 3 and 4. FIG. 3 is a partial sectional view schematically illustrating the lock and the valve of the door assembly according to the first embodiment of the present invention when the door of the electric oven is unlocked, and FIG. 4 is a partial sectional view schematically illustrating the lock and the valve of the door assembly according to the first embodiment of the present invention when the door of the electric oven is locked.

The valve 260 may include a first member 261 which opens and closes a portion, especially the upper portion, of the first air gap 201 and a second member 263 extended from the first member 261 and movable along with the first member 261. The first and the second members 261 and 263 have an angled shape, for example, having a generally "L" shape, as shown in FIGS. 1 to 4.

The valve 260 may further include a pivot 265 provided at a portion at which the first member 261 and the second member 262 are connected with each other. The pivot 265 is coupled to the frame 280 of the door 280 so that the first member 261 and the second member 263 can rotates together about the pivot 265. The valve 260 may further include an elastic member (not shown) which allows the first member 261 and the second member 263 to return to an initial position thereof. The elastic member may be formed as a spring which is installed between the frame 280 and the second member 263 or the pivot 265.

The first member 261 of the valve 260 seals the upper portion of the first air gap 201 when the valve 260 is at the initial position thereof. At this time, the elastic member (not shown) pushes the first member 261 of the valve 260 toward the upper portion of the first air gap 201 and thereby a secure sealing of the first air gap 201 is guaranteed. The elastic member 265, on the other hand, urges the first member 261 to return to the initial position when the valve 260 opens the first air gap 201.

The lock 270 may include an actuator 271 and a rod 273 as shown in FIGS. 3 and 4. The actuator 271 may be located within the electric outfit room 150 provided above the heating chamber 110. The rod 273 is coupled to the actuator 271 and is operable by the actuator 271. In the first embodiment of the lock 270, the rod 273 includes a hook provided at an end of the rod 273, and the actuator 271 swings the rod 273 in order to lock/unlock the door 200, as shown in FIG. 5.

An opening 281 is provided at a portion of the frame 280 which is located between the lock 270 and the valve 260 so that the rod 273 is able to pass through the opening 281 when swinging. When the rod 273 is at an initial position thereof, the rod 273 is located within the electric outfit room 150 and therefore the rod 273 does not project from the case 100 as illustrated by a solid line in FIG. 5. In this case, the door 200 is openable because the rod 273 does not hook the door 200.

Figure 5:
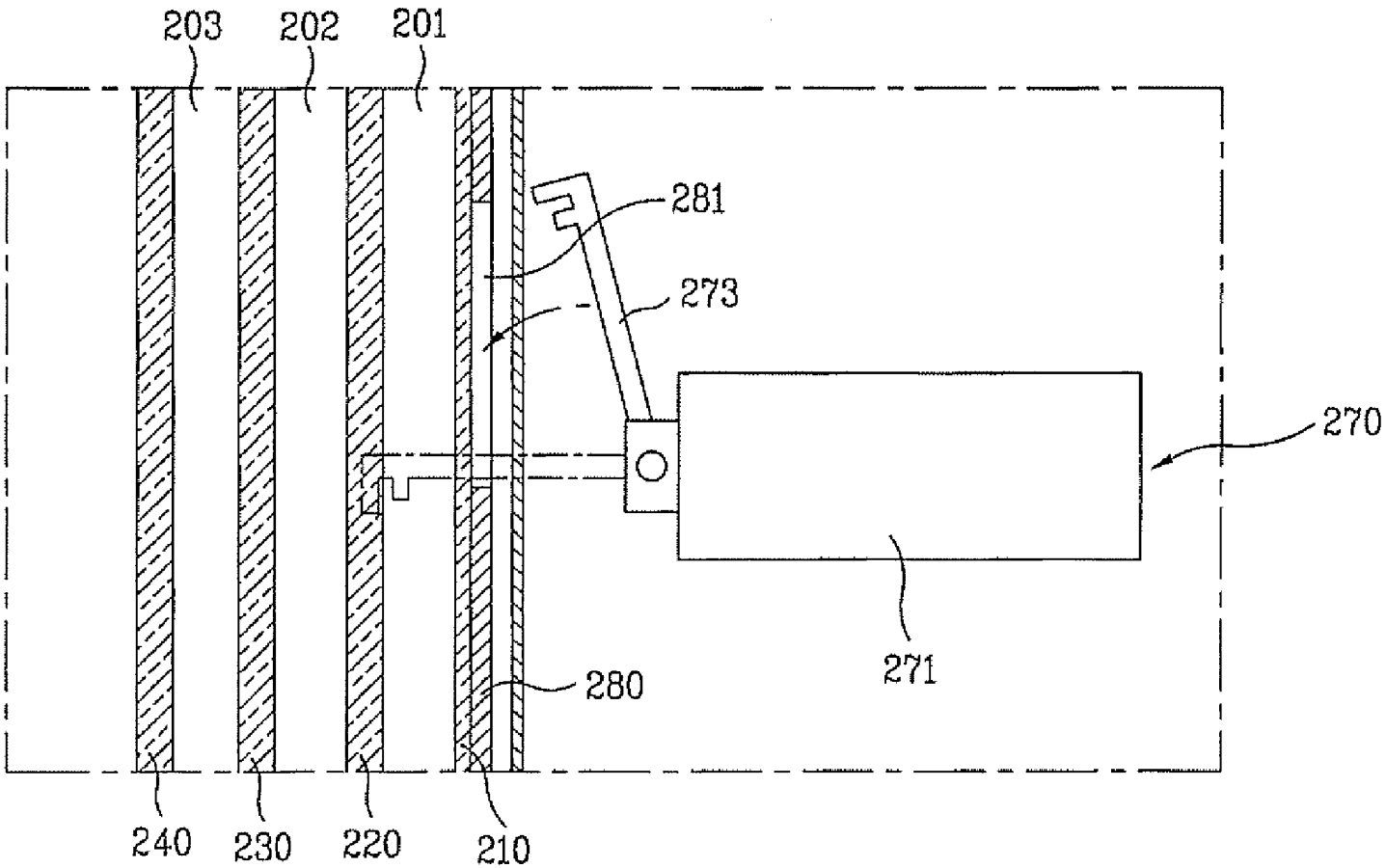
FIG. 5 is a partial plan view schematically illustrating working mechanism of the lock shown in FIGS. 3 and 4.

When the actuator 271 operates the rod 273 to lock the door 200, the rod 273 swings counterclockwise as illustrated by a dotted line in FIG. 5. In this case, the rod 273 projects from the case 100, passes through the opening 281 at the frame 280, and eventually hooks the door 200 by the hook. Accordingly, the door 200 is locked.

When the rod 273 swings by the actuator 271 in order to lock the door 200, the rod 273 also operates the valve 260 as shown in FIG. 4. More particularly, the rod 273 touches and pushes the second member 263 of the valve 260 when swinging in order to lock the door 200, and thereby the second member 263 is urged to rotate about the pivot 265, When the second member 263 rotates, the first member 261 also rotates because the first and second members 261 and 263 of the valve 260 are movable together. Therefore, the first air gap 201 is opened when the door 200 is locked by the lock 270. Meanwhile, the first air gap 201 is automatically closed by an elastic force of the elastic member (not shown) when the door 200 is unlocked. Of course, it should be appreciated that any suitable arrangement capable of locking and unlocking the door can be employed.

Figure 6:
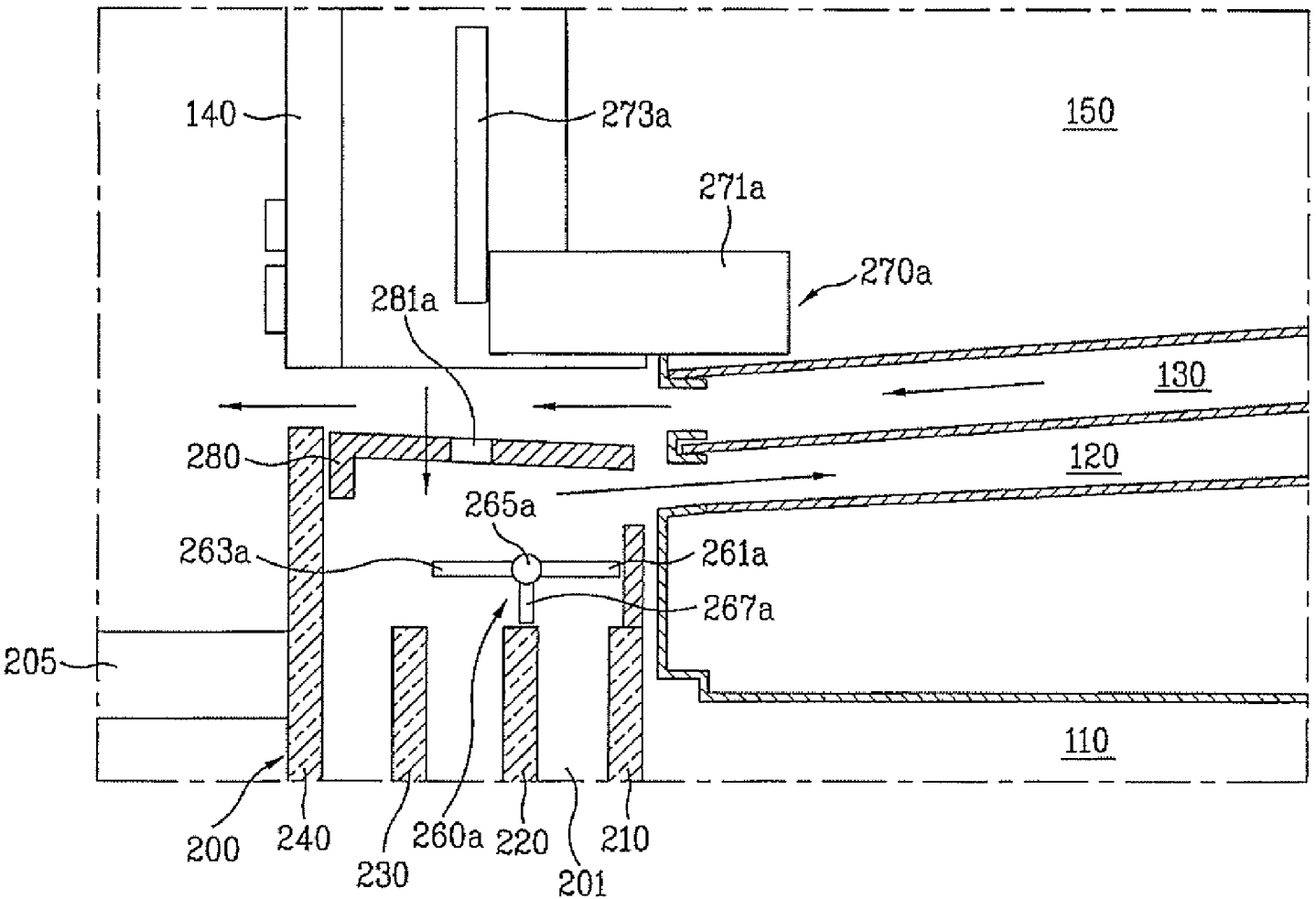
FIG. 6 is a partial sectional view schematically illustrating the lock and the valve of the door assembly according to the second embodiment of the present invention when the door of the electric oven is unlocked.
Figure 7:
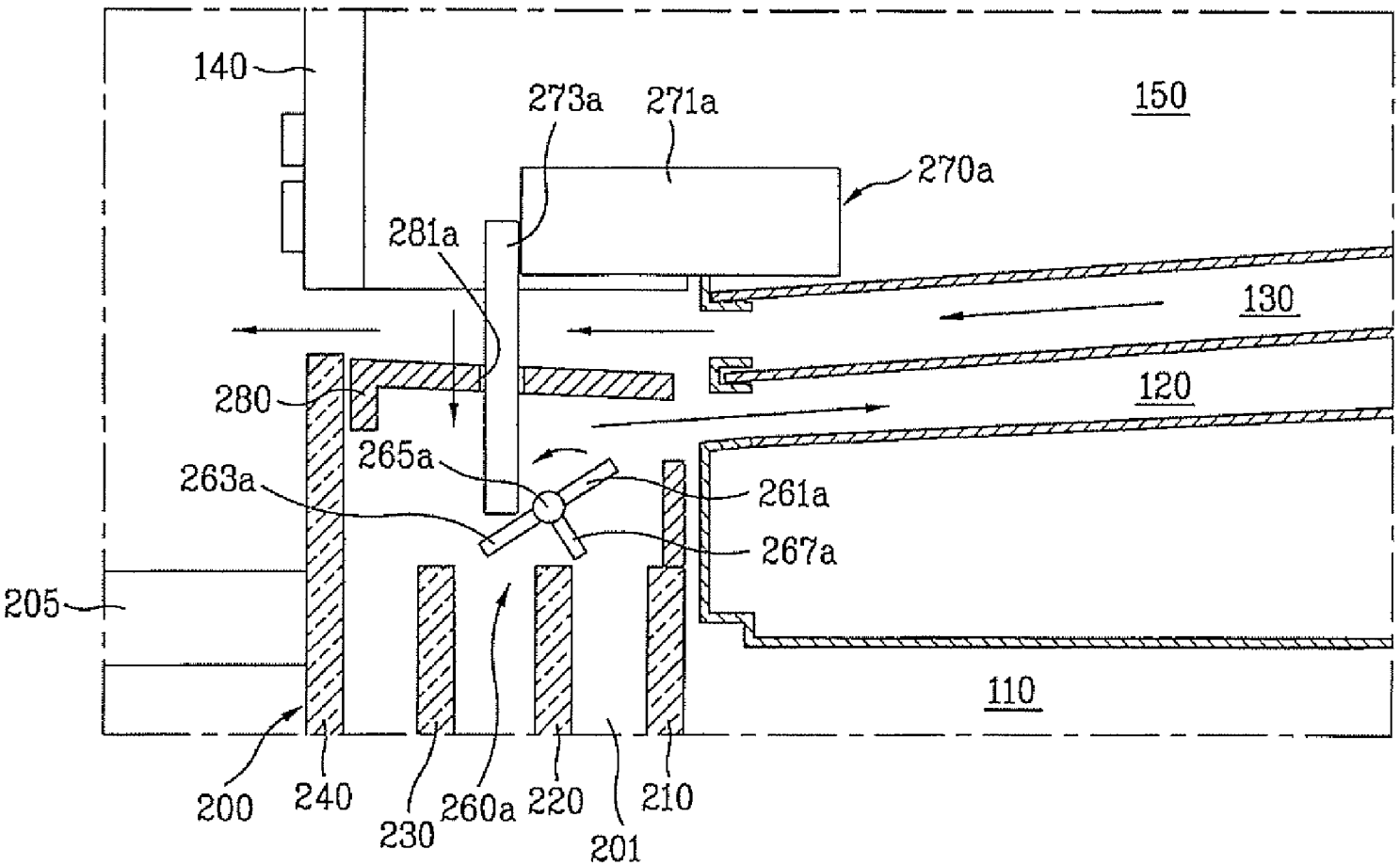
FIG. 7 is a partial sectional view schematically illustrating the lock and the valve of the door assembly according to the first embodiment of the present invention when the door of the electric oven is locked.

FIGS. 6 and 7 show a valve 260*a* and a lock 270*a* according to the second embodiment of the present invention. Therefore, more detailed explanation about the valve 260*a* and the lock 270*a* will be described referring to FIGS. 6 and 7. FIG. 6 is a partial sectional view schematically illustrating the lock and the valve of the door assembly according to the second embodiment of the present invention when the door of the electric oven is unlocked, and FIG. 7 is a partial sectional view schematically illustrating the lock and the valve of the door assembly according to the first embodiment of the present invention when the door of the electric oven is locked.

The valve 260*a* may include a first member 261*a*, a second member 263*a*, and a pivot 265*a*. The first member 261*a* covers a portion, for example, the upper portion, of the first air gap 201 to seal the first air gap 201. The second member 263*a* extends from the first member 261*a* toward a side opposite to the first member 261*a* and the pivot 265*a* is provided at a connection portion of the first and the second members 261*a* and 263*a*.

The valve 260*a* may further include a fourth member 267*a* that extends from the connection portion of the first and the second members (261*a* and 263*a*, respectively) toward a top of the second glass 220 in case there is a gap between the first member 261*a* and the top of the second glass 220 in order to cover the gap between the first member 261*a* and the top of the second glass 220 so that the first air gap 201 is securely sealed by the valve 260*a*. The valve 260*a* may further include an elastic member (not shown) which allows the first member 261*a* and the second member 263*a* to return to an initial position thereof. The elastic member may be formed as a spring which is installed between the frame 280 and the second member 263*a* or the pivot 265*a*.

The lock 270 may include an actuator 271*a* and a rod 273*a*. The actuator 271*a* may be located within the electric outfit room 150, e.g., above the door 200, as shown in FIGS. 6 and 7. The rod 273*a* is coupled to and operable by the actuator 271. More particularly, the rod 273*a* pushes the rod 273*a* out of the case 100 to lock the door 200. The rod 273*a* operates the valve 260*a* while being pushed by the actuator 270*a*.

An opening 281*a* is provided at the top of the door 200 so that the rod 273*a* can face the second member 263*a* of the valve 260*a* through the opening 281*a*. When the rod 273*a* is at an initial position thereof, the rod 273*a* is located within the electric outfit room 150 and therefore the rod 273*a* does not project from the case 100 as shown in FIG. 6. In this case, the door 200 is openable because the rod 273*a* does not hook the door 200.

When the actuator 271*a* of the lock 270*a* operates the rod 273*a* to lock the door 200, the rod 273*a* projects downward as shown in FIG. 7. In this case, the rod 273*a* projects from the case 100, passes through the opening 281*a* at the frame 280, and eventually hooks the door 200. Thereby, the door 200 is locked.

When the rod 273*a* projects downward by the actuator 271*a* in order to lock the door 200, the rod 273*a* also operates the valve 260*a* as shown in FIG. 7. More particularly, the rod 273*a* pushes down the second member 263*a* of the valve 260*a*, and thereby the second member 263*a* is urged to rotate about the pivot 265*a*. When the second member 263*a* rotates, the first member 261*a* also rotates because the first and second members 261*a* and 263*a* of the valve 260*a* are movable together. Therefore, the first air gap 201 is opened when the door 200 is locked by the lock 270*a*. Meanwhile, the first air gap 201 is automatically closed by an elastic force of the elastic member (not shown) when the door 200 is unlocked.

Meanwhile, the lock 270, 270*a* and the valve 260, 260*a* may be operable according to the operation mode of the electric oven. For example, the lock 270, 270*a* may lock the door 200 during the operation of the electric oven in the automatic cleaning mode while the lock 270, 270*a* unlocks the door 200 during the operation of the electric oven in the cooking mode. In this case, the valve 260, 260*a* permits the air to enter the first air gap 201 to cool down the door 200 when the electric oven performs the automatic cleaning mode while the valve 260, 260*a* prevents the air from entering the first air gap 201 to insulate the heat in the heating chamber 110 in order to improve the thermal efficiency of the electric oven when the electric oven performs the cooking mode.

Alternatively, the lock 270, 270*a* and the valve 260, 260*a* may be operable according to a temperature of the heating chamber 110. For example, the lock 270, 270*a* locks the door 200 when the temperature of the heating chamber 110 reaches a preset value while the lock 270, 270*a* unlocks the door 200 when the temperature of the heating chamber 110 is under the preset value. In this case, the valve 260, 260*a* allows the air to enter the first air gap 201 to cool the door 200 down when the temperature of the heating chamber 110 is at or above the preset value while preventing the air from entering the first air gap 201 to isolate the heat in the heating chamber 110 in order to improve the thermal efficiency when the temperature of the heating chamber 110 is under the preset value.

In operation of the electric oven, the heating chamber 110 is heated by the heaters 301 and 302 upon the user's request.

When the electric oven performs the cooking mode or the temperature of the heating chamber 110 does not reach the preset value, the lock 270, 270*a* unlocks the door 200 and the valve 260, 260*a* closes the first air gap 201 within the door 200 to insulate the heat in the heating chamber 110, and thereby the thermal efficiency of the electric oven increases. In case additional air gaps 202 and 203 are provided, within the door 200, next to the first air gap 201, the fan 400 may urge the air outside the case 100 to flow through the air gaps next to the first air gap 201 to cool down the outer surface of the door 200, and thereby the door 200 is prevented from hurting the user even if the user accidentally touches the door 200.

When the electric oven performs the automatic cleaning mode or the temperature of the heating chamber 110 reaches the preset value, the lock 270, 270*a* locks the door 200 and the valve 260, 260*a* opens the first air gap 201 within the door 200 to allow the air outside the case 100 to enter the first air gap 201 and the fan 400 flows the air through the first air gap 201 to cool the door 200 down so that the electric oven guarantees the user's safety. Of course, in case the additional air gaps 202 and 203 are provided within the door 200, the fan 400 may urge the air outside the case 100 to flow through the air gaps next to the first air gap 201 to cool down the door 200. Accordingly, the heating chamber 100 and the case 100 are prevented from being overheated.

As explained above, the present invention has the following advantages. The electric oven according to the present invention minimizes a loss of the thermal efficiency by isolating the heat in the heating chamber during an operation of the electric oven and also guarantees the user's safety by cooling the door during another operation of the electric oven. In addition, the electric oven according to the present invention also guarantees a reliability of the product by preventing the heating chamber and the case from being overheated. Further, food deposited in the heating chamber is evenly cooked and the cooking time decreases because the door isolates the heat in the heating chamber while cooking. Furthermore, the present invention improves efficiency for cooling an electric outfit room of the electric oven because the first and the second vent holes provided the vicinities of the control panel and the motor guide the air outside the case to a control panel and a motor of the fan.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

It is further noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An electric oven comprising:

a case;

a heating chamber in the case;

a door that opens and closes the heating chamber, the door including a first glass facing the heating chamber and a second glass located proximate the first glass, and the first and second glasses forming a first air gap in the door;

a valve provided in the door, wherein the valve is selectively operated to allow air inside the first air gap to be discharged from the first air gap to cool the door; and a lock that selectively locks the door, wherein the valve is operatively coupled to the lock such that the lock controls movement of the valve, the lock comprising:

an actuator and a rod operatively coupled to the actuator, wherein the rod moves the valve to open the first air gap when the door is locked, and the actuator being mounted in the case and configured to either one of swing and push the rod to hook the door and push the valve.

2. A door assembly for a home appliance, comprising:

a door that opens and closes a heating chamber, the door including a first plate and a second plate which form a first air gap in the door to insulate heat in the heating chamber, the door including a third plate provided proximate the second plate to form a second air gap in the door through which air flows to cool the door, and the first air gap being positioned between the second air gap and the heating chamber;

a valve provided in the door, wherein the valve is selectively operated to allow air inside the first air gap to be discharged from the first air gap to cool the door; and a lock that selectively locks the door, wherein the valve is operatively coupled to the lock, wherein the valve comprises:

a first member that opens and closes a portion of the first air gap, a second member movable along with the first member, and the lock configured to move both the first and second members, and a pivot about which the first and second members rotate together when the lock engages the second member.

3. The door assembly for home appliance of claim 2, wherein the lock comprises:

an actuator; and a rod operatively coupled to the actuator, wherein the rod is configured to move the valve such that a portion of the first air gap is opened when the door is locked.

4. The door assembly for home appliance of claim 2, wherein the valve further comprises:

an elastic member configured to allow the first and second members to return to an initial position of the first and second members.

5. An electric oven comprising:

a case;

a heating chamber in the case;

a door that opens and closes the heating chamber, the door including a first glass facing the heating chamber and a second glass located proximate the first glass, the first and second glasses forming a first air gap in the door, the door including a third glass provided proximate the second glass to form a second air gap in the door through which air flows to cool the door, and the first air gap being positioned between the second air gap and the heating chamber; and a valve provided in the door, wherein the valve is selectively operated to allow air inside the first air gap to be discharged from the first air gap to cool the door, and a lock that selectively locks the door, wherein the valve is operatively coupled to the lock such that the lock controls movement of the valve, the lock comprising:

an actuator and a rod operatively coupled to the actuator, wherein the rod moves the valve to open the first air gap when the door is locked, and the actuator being mounted in the case and configured to either one of swing and push the rod to hook the door and push the valve.

6. The electric oven of claim 5, wherein the door further comprises:

a supporter which supports the first, second, and third glasses thereon, wherein the supporter is configured to permit air to flow into the second air gap while preventing air from flowing into the first air gap.

7. The electric oven of claim 5, wherein the valve comprises:

a first member that opens and closes a portion of the first air gap;

a second member movable along with the first member, and the lock is configured to move both the first and second members;

a pivot about which the first and second members rotate together when the lock touches the second member; and an elastic member which allows the first and second members to return to an initial position of the first and second members.

8. The electric oven of claim 5, wherein the valve permits the air to flow into the first air gap to cool the door when a temperature of the heating chamber reaches a preset value.

9. The electric oven of claim 5, wherein the valve permits the air to flow into the first air gap to cool the door when the electric oven performs a preset operation mode.

10. The electric oven of claim 5, further comprising a fan that introduces air outside the case into the case to cool a circumference of the heating chamber and into the door to cool the door.

11. The electric oven of claim 5, further comprising a first vent hole provided on the case, wherein the first vent hole introduces air outside the case to a proximity of a control panel to cool the control panel.

12. The electric oven of claim 10, further comprising a second vent hole provided on the case, wherein the second vent hole introduces air outside the case to a proximity of a motor of the fan to cool the motor.

13. An electric oven comprising:

a case;

a heating chamber in the case;

a door that opens and closes the heating chamber, the door including first and second air gaps therein, the second air gap being configured to allow air to flow therethrough to cool the door, and the first air gap being arranged between the second air gap and the heating chamber;

a fan provided in the case, wherein the fan is configured to allow air to flow through the second air gap to cool the door;

a valve provided in the door, wherein the valve is selectively operated to allow air inside the first air gap to be discharged from the first air gap to cool the door; and a lock that selectively locks the door, wherein the valve is operatively coupled to the lock such that the lock controls movement of the valve, the lock comprising:

an actuator and a rod operatively coupled to the actuator, wherein the rod moves the valve to open the first air gap when the door is locked, and the actuator being mounted in the case and configured to either one of swing and push the rod to hook the door and push the valve.

* * * * *